US007475804B2

(12) United States Patent
Clegg et al.

(10) Patent No.: US 7,475,804 B2
(45) Date of Patent: Jan. 13, 2009

(54) POP UP TRAY CONTAINER

(75) Inventors: Timothy Clegg, Manhattan Beach, CA (US); David Rosendale, Torrance, CA (US)

(73) Assignee: Americhip Inc., Torrance, CA (US)

( * ) Notice: Subject to any disclaimer, the term of this patent is extended or adjusted under 35 U.S.C. 154(b) by 469 days.

(21) Appl. No.: 11/140,407

(22) Filed: May 28, 2005

(65) Prior Publication Data

US 2006/0266811 A1 Nov. 30, 2006

(51) Int. Cl.
*B65D 5/10* (2006.01)
*B65D 5/46* (2006.01)
*B65D 25/34* (2006.01)

(52) U.S. Cl. ..... 229/116.1; 229/117; 229/117.14; 229/122.32

(58) Field of Classification Search ..... 229/116.1, 229/117, 922, 122.34, 125.32, 122.33, 117.4, 229/122.32; 206/163; 446/79, 71, 80, 73, 446/77

See application file for complete search history.

(56) References Cited

U.S. PATENT DOCUMENTS 3,866,814 A * 2/1975 Bissler ..... 229/116.1
4,230,261 A * 10/1980 Austin ..... 229/117
4,474,324 A * 10/1984 Forbes, Jr. ..... 229/117
5,620,134 A * 4/1997 Gulliver ..... 229/117.14
5,682,999 A * 11/1997 Larson ..... 206/768
6,036,085 A * 3/2000 Tsao ..... 229/117.14
2002/0170950 A1* 11/2002 Escamila ..... 229/116.1

* cited by examiner

*Primary Examiner*—Nathan J Newhouse
*Assistant Examiner*—Christopher Demeree
(74) *Attorney, Agent, or Firm*—Clement Cheng

(57) ABSTRACT

A food container has a box base with four side panels and four bottom flaps extending from the respective side panels to close the floor of the box base leaving the top open. The bottom flaps are so designed and glued together that the box sides can be folded flat for stacking and then unfolded into a box structure having its bottom wall closed automatically. The box base provides food-receiving area while carrying and serving the eatery. Raised from the top of the box base are circumferential edges defining a tray top. The tray top carries out the decorative role when it is popped open as is possible thanks to the inventive folding scheme implemented in the tray top. The tray top also has carrying handles for the user. The front face of the tray top in the serving mode can be decorated with various cutouts shaped as interesting objects.

19 Claims, 4 Drawing Sheets

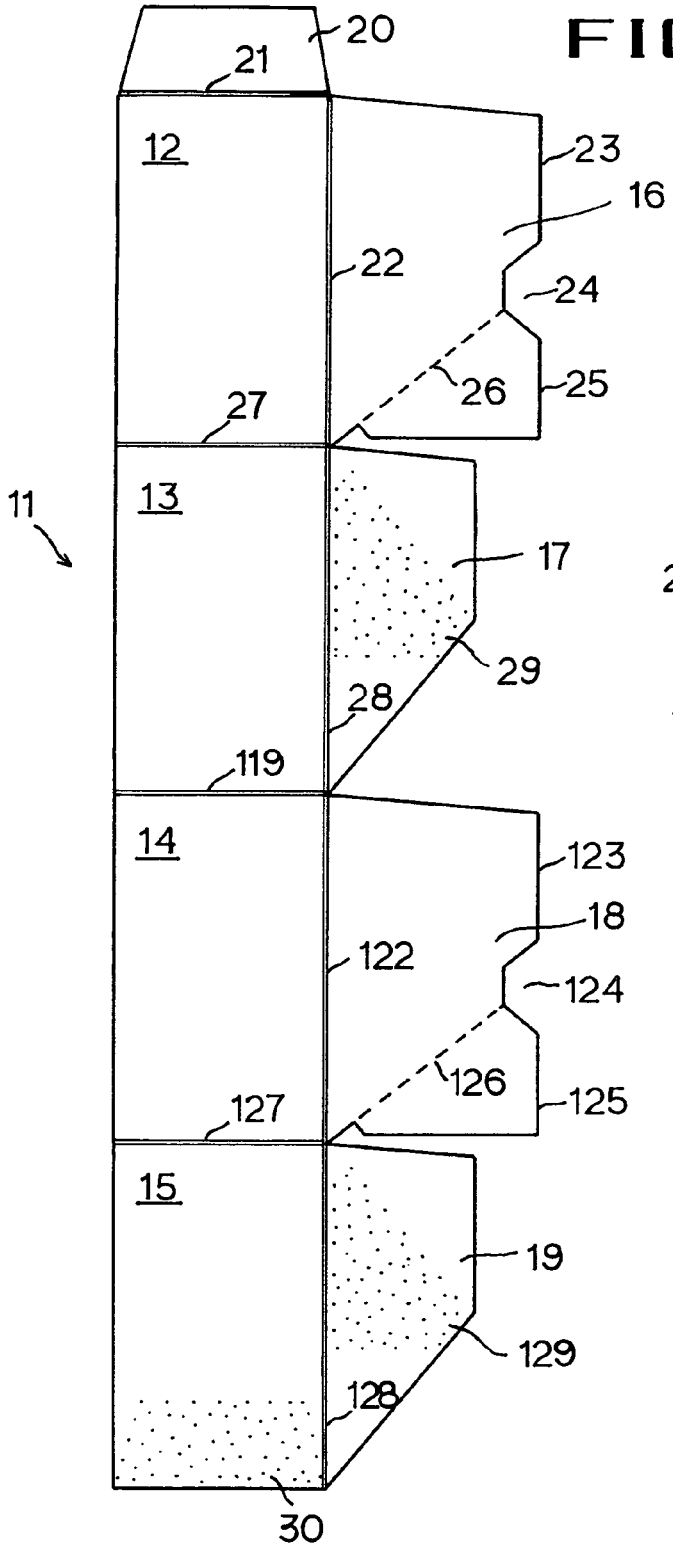
FIG. 2
FIG. 3
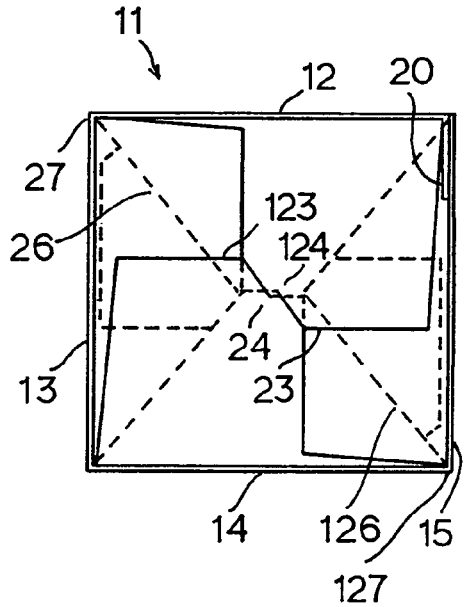

POP UP TRAY CONTAINER

BACKGROUND OF THE INVENTION

A. Field of the Invention

The present invention relates to a pop up tray container, and more particularly to a carryout food container that becomes a pop-open tray.

B. Description of the Prior Art

It has been customary in the fast-food industry that customers, especially kids are offered a pleasant dining mood in an inexpensive way. When parents feel they deserve a break that day, they can go to a fast food diner and buy a their kid a kids meal which is often served or packed in a paper container having kid-friendly designs. Paper is generally used to fabricate such kids meal boxes, which are normally equipped with integral handles and are printed externally with restaurant or company logos and popular characters for festive moods. This promotes a good time with a great taste so that kids will feel comfortable at the fast food diner.

Others, like Mason's U.S. Pat. No. 4,326,356 show food a tray, which can be converted into a toy of hand puppet after consuming the meal out of the tray. However, these disposable type containers are sometimes too boxy to enhance a dining pleasure for certain social gatherings such as birthday parties unless they are covered with trendy entertainment characters and prints such as relatively proprietary and expensive copyrighted materials. In addition, the entertainment value, of the current boxes can be enhanced if a user can play with the box during the meal.

Also, to enjoy an easy dining experience on conventional disposable trays is not an easy task because they were designed with food carrying first in mind rather than aesthetic appeal. So, there is a need for improving a disposable food container in such a way as to provide a container structure, which can display its built-in entertaining factor when it works as a full size food tray but occupies a compact space when closed in a carrying mode.

SUMMARY OF THE INVENTION

The device can be used as a generic container storing articles such as perfume, beauty products, electronic goods as well as food. Because food is the preferred article for storage, the specification specifically mentions the food embodiments. However, the container can be modified for storage and presentation of a wide variety of articles.

The container of the present invention comprises a box base having four side panels and four bottom flaps extending from the respective side panels to close the floor of the box base leaving the top open. The bottom flaps are so designed and glued together that the box sides can be folded flat for stacking and shipping and then unfolded into a box structure having its bottom wall closed automatically. The box base provides food-receiving area while carrying and serving the food.

Raised from the top of the box base are circumferential edges defining a tray top. The tray top carries out the decorative role when it is popped open as is possible thanks to the inventive folding scheme implemented in the tray top. The tray top also has carrying handles for the user.

The face of the tray top shown to the user in the serving mode can be decorated with various cutouts shaped into interesting objects to kids and others.

Accordingly, the general object of the present invention is to provide a food container, which pops open into a tray. Another object is to provide a combination food carryout box and serving tray where the box can hold the food in a safe and reliable manner while the tray is transformable between a top closure with compact footprint and a wide round tray giving an ample decorating as well as serving areas. Another object is to promote food, folks and fun by providing a food container with tray that automatically forms its ornamental pop up features during opening.

BRIEF DESCRIPTION OF THE DRAWINGS

FIG. 2 is an exploded view of the box base of the food container shown in FIG. 1.

FIG. 3 is a plan view of the box base of FIG. 1 finished into a subassembly.

Embodiments of the invention will now be described by way of example with reference to the accompanying drawings.

DETAILED DESCRIPTION OF THE PREFERRED EMBODIMENT

Figure 1:
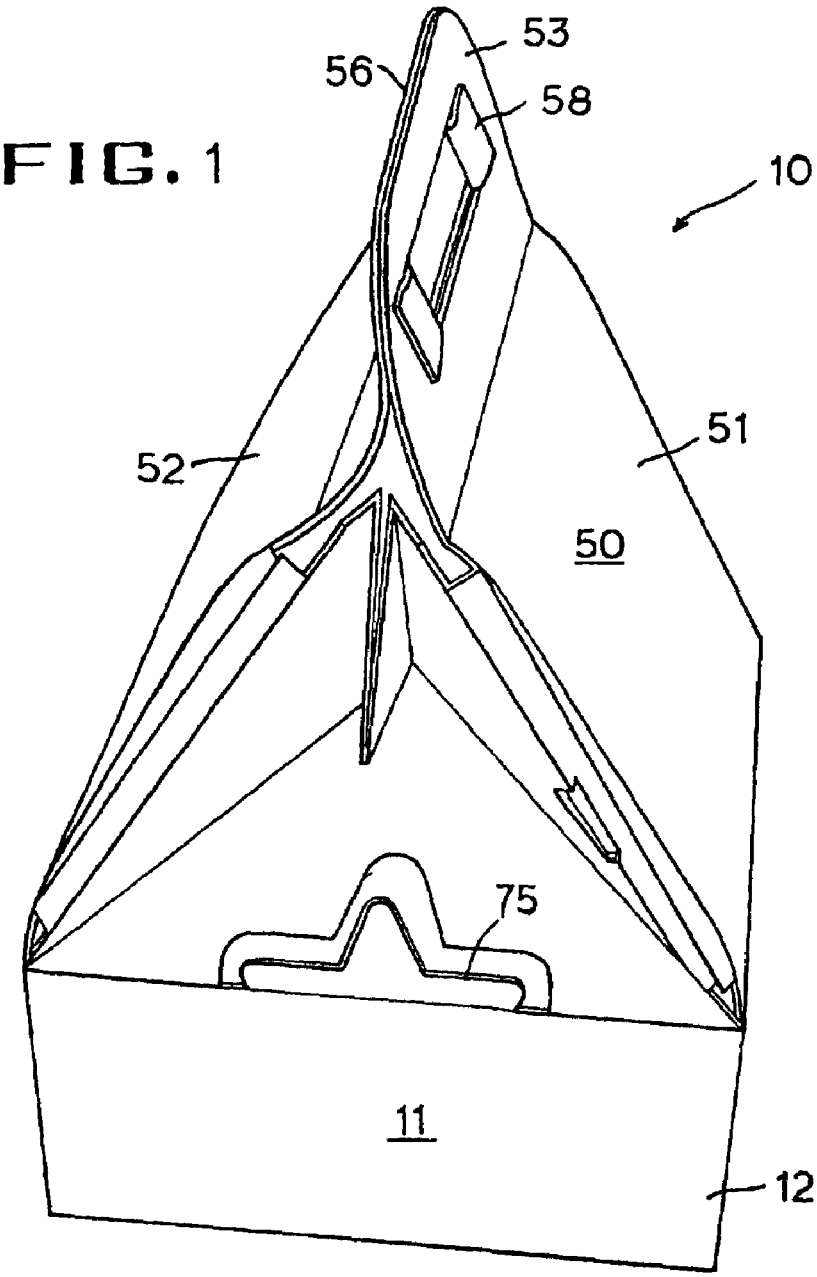
FIG. 1 is a perspective view of the food container of the present invention.

Referring to FIGS. 1 to 3, container 10 has a box base 11 at its bottom section. The base 11 has four rectangular side panels 12 to 15 and four bottom flaps 16 to 19. The base 11 houses food and articles to be carried within. The box is convertible between a closed box container position and an open tray container position.

Container 10 also has a tray top 50 that extends from the top edges of the side panels 12 to 15. In the embodiment illustrated, base 11 is made of a piece of substrate and tray top 50 is of another piece of the same material. Both components can be simultaneously punched out from a blank and processed with creases or folding lines, which will be detailed further below. The current invention can be made of a variety of materials currently known and used in prior art kid meal food containers. Kid meal food containers are currently made of paper typically of a 50 lb weight or sometimes served in colorful paper bags.

Box base 11 has first side panel 12 that is rectangular and has at its first side a securing flap 20 with a folding line 21 therebetween. To a second side of the side panel 12 adjacent to the first side is connected a bottom flap 16 through fold line 22. The bottom flap 16 has a male locking edge 23 and a female locking edge 24, which is defined by a triangular securing flap 25 attached to the bottom flap 15 in a folding connection along line 26. The bottom can be glued shut such as by contact adhesive or closed by physical engagement between flaps.

A second side panel 13 is connected to the first side panel 12 at the opposite of its first side via a fold line 27. The side panel 13 has a bottom flap 17 connected thereto via a fold line 28. The bottom flap 17 will be bonded together with the triangular flap 25 at a bonding area, which is specifically shown in dots at 29. From FIG. 2 the triangular flap 25 will lay underside of the bonding area 29 of the bottom flap 17 as the side panels 12 and 13 are brought together into a 90-degree folding position. Therefore, the side panels 12 and 13 can be folded further into a flat profile along folding lines 26 and 27.

The side panels 14 and 15 have similar configurations to the pair of side panels 12 and 13 except that the panel 15 has a bonding area 30 disposed at the opposing end against the securing flap 21.

A third side panel 14 is rectangular and connected at its first side to the second side panel 13 via a folding line 119. To a second side of the side panel 14 adjacent to the first side is connected a bottom flap 18 through fold line 122. The bottom flap 18 has a male locking edge 123 and a female locking edge 124, which is defined by a triangular securing flap 125 attached to the bottom flap 18 in a folding connection along line 126. Upon completion of the box base 11 as shown in FIG. 3, the female and male locking edges 124 and 123 will engage the male and female locking edges 23 and 24 at the first pair of bottom flaps 16 and 17, respectively.

A fourth side panel 15 is connected to the third side panel 14 at the opposite of its first side via a fold line 127. The side panel 15 has a bottom flap 19 connected thereto via a fold line 128. The bottom flap 19 will be bonded together with the triangular flap 125 at a bonding area, which is specifically shown in dots at 129. From FIG. 2 the triangular flap 125 will lay underside of the bonding area 129 of the bottom flap 19 as the side panels 14 and 15 are brought together into a 90-degree folding position. Therefore, the side panels 14 and 15 also can be folded further in the finished box base 11 along folding lines 126 and 127 allowing the base 11 to lie flat laterally in space saving stacks or easy transport before serving by the restaurants.

Figure 4:
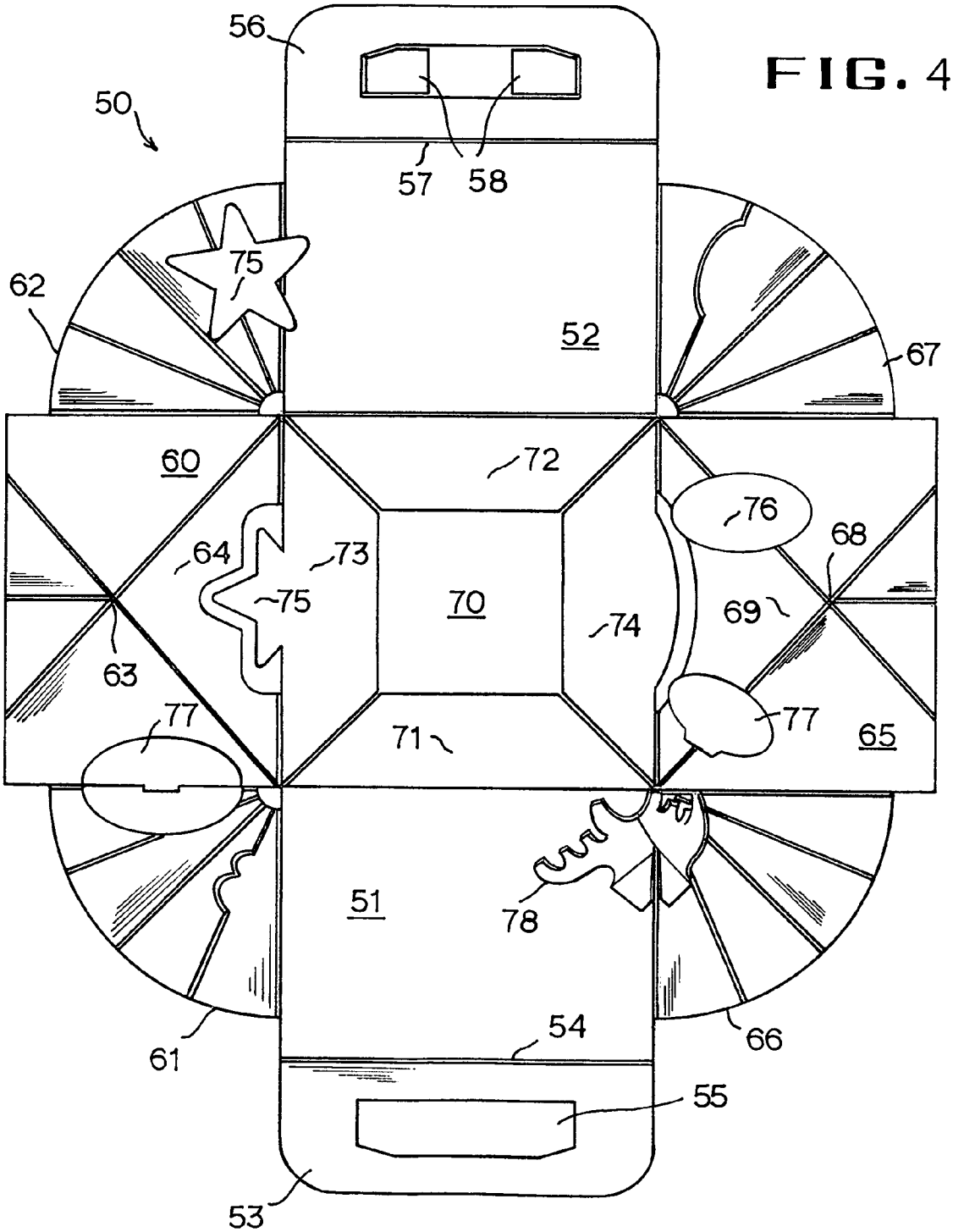
FIG. 4 is a plan view of the tray top section of the food container showing its open position to serve food.

Turning now to FIG. 4, the tray top 50 can be made of a piece of substrate such as paper, plastic and the like and has a front panel 51 and a rear panel 52 disposed at the opposite side of the front panel 51. At the top or outer end of the front panel 51 a handle 53 is connected via a fold line 54 and provided at its center with a cut-out 55. Likewise, at the top or outward end of the rear panel 52 a handle 56 is connected through a folding line 57. In addition, the handle 56 is cut so that a pair of locking flaps 58 is formed therein. The flaps 58 can be folded over the opposite handle 53 through its cut-out center 55 into a locking engagement when the tray top 50 is closed as shown in FIG. 1.

Between the two panels 51 and 52 there is provided a first side panel 60 connected to a first side edge of the panel 51 via a first corner panel 61 and also to a first side edge of the panel 52 via a second corner panel 62. Each of the corner panels 61 and 62 may have multiple folds and the present embodiment shows three of them. And adjacent folds in the corner panels 61 and 62 are in opposite directions to each other. On the first side panel 60 there are a number of fold lines converging at point 63 to define triangular sections there. In the current embodiment of the invention, fold lines of five define five panel sections, of which a main triangular section 64 permits the outer ends of the front and rear panels 51 and 52 to meet together in a closing mode of the tray top 50.

A second side panel 65 is between the two panels 51 and 52 at their opposite side of the first side panel 60. The second side panel 65 is connected to a second side edge of the front panel 51 via a third corner panel 66 and also to a second side edge of the rear panel 52 via a fourth corner panel 67. Each of the corner panels 66 and 67 may have multiple folds and the current embodiment shows three of them. Adjacent folds in the corner panels 66 and 67 are in opposite directions to each other. On the second side panel 65 there are a number of fold lines converging at point 68 to define triangular sections in the panel 65. In the current embodiment of the invention, fold lines of five define five panel sections, of which a main triangular section 69 aids in the closure of the outer ends of the front and rear panels 51 and 52 of the tray top 50.

The corner panels 61, 62, 66, 67 extending from adjacent side edges connect each of the four panels 51, 52, 60, 65 of the tray section to each other. When the box is initially opened, the folds in the corner panels act as springs with tension holding up the opposing panels and not letting them touch the table's surface. The corner panels 61, 62, 66, 67 have folds that bias the container in open position when the panels are opened past equilibrium position. When the panels are folded past the about horizontal equilibrium position, the corner panels bias the container in the open position. Preferably, in the open tray position the panels touch the table's surface expanding the footprint of the device many times. When used as a food tray, the interior of the box is preferably made of water resistant paper such as paper coated with wax.

This results in a circumferential arrangement of the panels of the tray 50 leaving a central food holding opening 70, which will be aligned with the top of the box base 11. At the inner end of the panel 51 a connecting flap 71 extends into the opening 70 where a connecting flap 72 is extended from the inner end of the panel 52. Also, the inner end of the panel 60 has a connecting flap 73 extending into the opening 70 where a connecting flap 74 is extended from the opposite inner end of the panel 65.

These connecting flaps 71 to 74 are separated by cuts and in folding relationships with their respective panels to facilitate the assembly between the box base 11 and the tray top 50. Connecting flaps 71 to 74 may be glued to the inside walls of the box base 11 prepared as in FIG. 3 to finish the container 10 of the invention.

Figure 5:
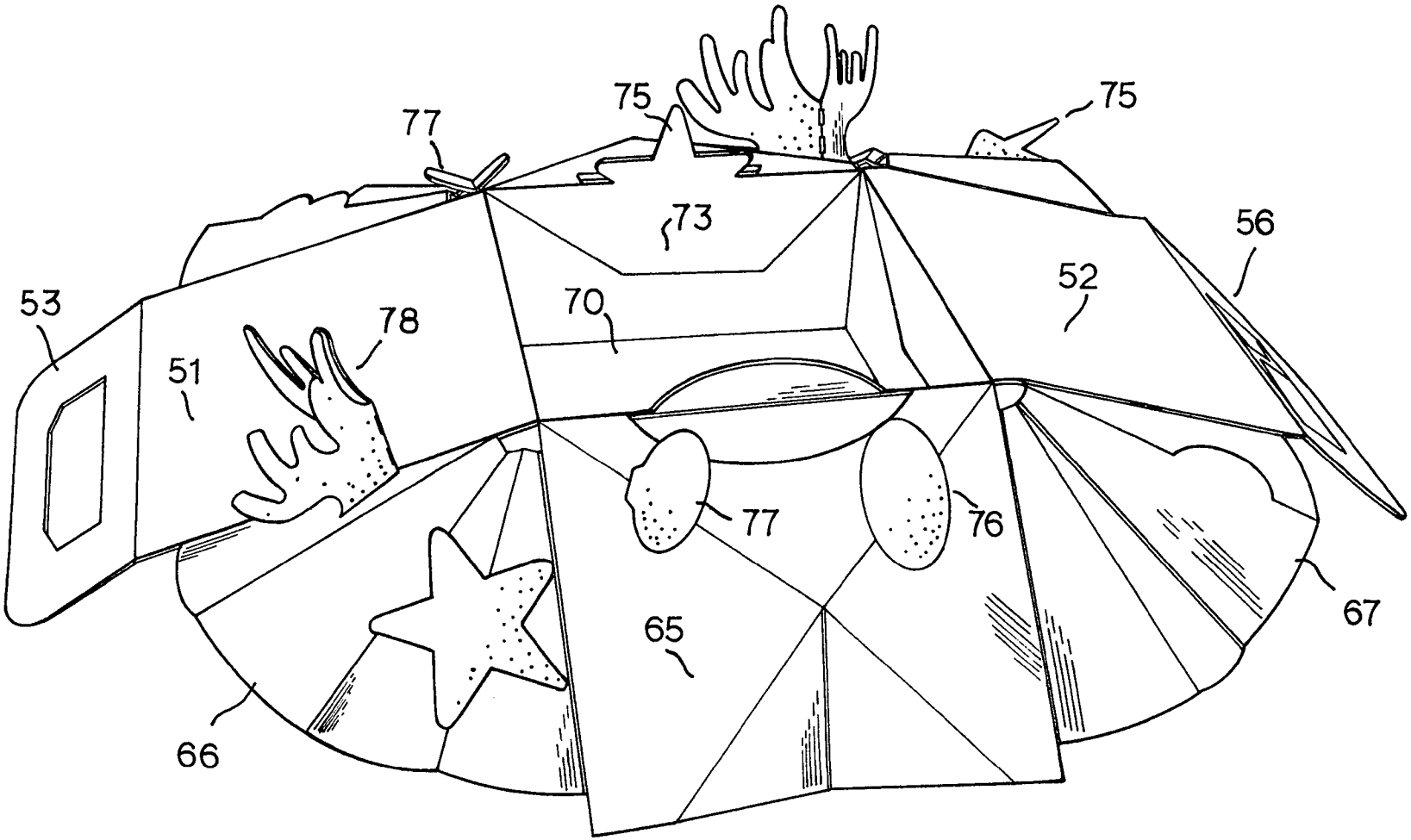
FIG. 5 is a perspective view of the food container showing its open position to serve food.

FIGS. 4 and 5 show the ornamental feature of the inventive container 10. Here, the motif or theme is an aquarium where shapes of starfish 75, slugs 76, clams 77, coral 78 and the like are presented for pleasure to the eyes of the diner. The pop-up ornamental elements 75, 77, 78 can be made detachable by perforated tear off scoring. The pop-up ornamental elements are initially folded in the closed position and pop up into an open position when the box is opened and transformed into a tray. Various pop up techniques and means can be used for attaching pop up elements to the top of the trace surface.

In the first pop-up element 75, FIG. 4, a five pointed star has been cut from the triangular section panel 64 so that the element remains vertical and coplanar with the box sidewall and connecting flap 73 connecting flap. The remainder of the triangular section panel 64 bends into an about horizontal position allowing protrusion of the element 75. The second star element 75 is attached to the second corner panel and engages into the folded configuration allowing the end of the element 75 to protrude from the panel 62. In the preferred embodiment, the panel 62 retains the star element 75 in a fold.

The decorative element 78 appearing as acropora coral formation has attachment on panel 51 and 66 along a central fold line allowing the pop up of decorative element 78 when the device is opened into a tray. Many of the mechanics of the pop-up techniques are well known in the art and can be applied to the various folds of the tray top allowing a variety of pop up elements. The decorative elements can be repeated per the quadpartite geometric symmetry of the device in open tray configuration. The decorative elements preferably have a thematic continuity or relationship, but can also be purely random such as a sperm whale and a pot of petunias.

In addition to pop up elements, the tray container can also be adorned with paper mechanized designs such as a business card holder with a sound generating microchip as described in U.S. Pat. No. 5,275,285 granted to Clegg. Paper mechanized designs include a wide variety of interesting innovations. These include devices that rotate and move in ways that do not necessarily pop up to create a three-dimensional profile. Because the devices are well known in the art, the applicant will not present detail as to each and every one of them that could be attached to the top of the tray.

The present invention contemplates that many changes and modifications may be made. Therefore, while the presently preferred form of the food container has been shown and described, and several modifications thereof discussed, persons skilled in this art will readily appreciate that various additional changes and modifications may be made without departing from the spirit of the invention, as defined and differentiated by the following claims.

The invention claimed is:

1. A pop up tray container comprising:

a. a box section having four rectangular side panels and bottom flaps extending from each of said side panels to define an open container to retain food, said bottom flaps being engaged at selective areas thereof to form a bottom closure, which can be folded flat laterally to said side panels;

b. a tray section having four panels disposed radially on edges of said box section including a pair of opposite rectangular panels and a pair of opposite side panels each having triangular sections defined by a plurality of fold lines converging into a point to allow for closure of said rectangular panels at their tops to said converging points wherein the four panels disposed radially on upper edges of the box section are each attached to one of the four rectangular side panels, wherein the four rectangular side panels remain substantially vertically oriented when the container is in closed position; and c. said four panels of said tray section being connected to each other by corner panels extending from adjacent side edges, whereby said food container can be closed with said side and corner panels folded into said converging points, wherein there are four corner panels and each corner panel has multiple corner panel folds allowing the tray section having four panels to pop open and form a tray that has a tray top, wherein the four panels are capable of touching the table surface, wherein the four rectangular side panels remain substantially vertically oriented when the container is in open position.

2. The container set forth in claim 1, wherein said box and tray sections are made of paper.

3. The container set forth in claim 1, wherein said rectangular panels of said tray section have handles with central cut-outs, which are releasably locked together.

4. The container set forth in claim 1, wherein said tray section has a footprint no more than the area of said box section when said tray section is closed.

5. The container set forth in claim 4, wherein said tray section has a footprint at least twice as large as when said tray section is closed.

6. The container set forth in claim 1, wherein said tray section is decorated with pop up elements.

7. The container set forth in claim 1, wherein said tray section is decorated with paper mechanized designs elements.

8. A pop up tray container comprising:

a. a box section having four rectangular side panels and a bottom to define an open container;

b. a tray section having four panels disposed radially on upper edges of the box section including a pair of opposite rectangular panels and a pair of opposite side panels each having triangular sections defined by a plurality of fold lines to allow closure; wherein the four panels disposed radially on upper edges of the box section are each attached to one of the four rectangular side panels, wherein the four rectangular side panels remain substantially vertically oriented when the container is in closed position; and c. corner panels extending from adjacent side edges connecting each of the four panels of the tray section to each other, wherein the corner panels have folds that bias the container in open position when the panels are opened past equilibrium position, wherein there are four corner panels and each corner panel has multiple corner panel folds allowing the tray section having four panels to pop open and form a tray that has a tray top, wherein the four rectangular side panels remain substantially vertically oriented when the container is in open position.

9. The container set forth in claim 8, wherein said box and tray sections are made of paper.

10. The container set forth in claim 8, wherein said rectangular panels of said tray section have handles with central cut-outs, which are releasably locked together.

11. The container set forth in claim 8, wherein said tray section has a footprint no more than the area of said box section when said tray section is closed.

12. The container set forth in claim 8, wherein said tray section has a footprint at least twice as large as when said tray section is closed.

13. The container set forth in claim 8, wherein said tray section is decorated with pop up elements.

14. The container set forth in claim 8, wherein said tray section is decorated with paper mechanized designs elements.

15. A pop up tray food container comprising:

a. a box section made of water resistant paper having four rectangular side panels and a bottom to define an open container;

b. a tray section having four panels disposed radially on upper edges of the box section including a pair of opposite rectangular panels and a pair of opposite side panels each having triangular sections defined by a plurality of fold lines to allow closure, wherein the four panels disposed radially on upper edges of the box section are each attached to one of the four rectangular side panels, wherein the four rectangular side panels remain substantially vertically oriented when the container is in closed position; and c. corner panels extending from adjacent side edges connecting each of the four panels of the tray section to each other, wherein the corner panels have folds that bias the container in open position when the panels are opened past equilibrium position, wherein there are four corner panels and each corner panel has multiple corner panel folds allowing the tray section having four panels to pop open and form a tray that has a tray top, wherein the four rectangular side panels remain substantially vertically oriented when the container is in open position.

16. The pop up tray food container set forth in claim 15, wherein said tray section has a footprint no more than the area of said box section when said tray section is closed.

17. The pop up tray food container set forth in claim 15, wherein said tray section has a footprint at least twice as large as when said tray section is closed.

18. The pop up tray food container set forth in claim 15, wherein said tray section is decorated with pop up elements.

19. The pop up tray food container set forth in claim 15, wherein said tray section is decorated with paper mechanized designs elements.

* * * * *